US009617073B2

(12) United States Patent
McIntosh

(10) Patent No.: US 9,617,073 B2
(45) Date of Patent: Apr. 11, 2017

(54) CLOSEOUT COVER FOR WASTE RECEPTACLE OPENINGS

(71) Applicant: The Boeing Company, Chicago, IL (US)

(72) Inventor: Darren C. McIntosh, Mukilteo, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/319,432

(22) Filed: Jun. 30, 2014

(65) Prior Publication Data

US 2015/0375937 A1 Dec. 31, 2015

(51) Int. Cl.

| | |
|---|---|
| ***B65F 1/16*** | (2006.01) |
| ***B65F 1/00*** | (2006.01) |
| ***B65F 1/02*** | (2006.01) |
| ***B65F 1/06*** | (2006.01) |
| *B65F 1/14* | (2006.01) |

(52) U.S. Cl.

CPC ..... *B65F 1/1607* (2013.01); *B65F 1/004* (2013.01); *B65F 1/02* (2013.01); *B65F 1/067* (2013.01); *B65F 1/1473* (2013.01); *B65F 1/1615* (2013.01); *B65F 1/1646* (2013.01); *B65F 2001/1494* (2013.01); *B65F 2001/1676* (2013.01); *B65F 2210/1121* (2013.01)

(58) Field of Classification Search

CPC .... B65F 1/1607; B65F 1/1623; B65F 1/0033; B65F 1/004; B65F 1/1421; B65F 1/1473; B65F 2001/1653; B65F 2001/1494; B65F 3/005; B65F 2210/1121; B65D 43/20; B65D 2251/0081; B65D 2251/0018

USPC ..... 220/523, 255, 262, 908, 254.9, 253

See application file for complete search history.

(56) References Cited

U.S. PATENT DOCUMENTS

| | | | | |
|---|---|---|---|---|
| 1,124,395 | A * | 1/1915 | Cottrell | B65D 43/20 220/345.1 |
| 1,311,273 | A * | 7/1919 | Hackbirt | B65D 47/286 206/267 |
| 3,333,721 | A * | 8/1967 | Marek | B65D 11/1873 220/262 |
| 3,402,847 | A * | 9/1968 | Bridenstine | B65F 1/1607 220/253 |
| 3,720,346 | A * | 3/1973 | Cypher | B65D 25/06 220/254.4 |
| 3,934,894 | A | 1/1976 | Hoeffken et al. | |
| 5,105,968 | A | 4/1992 | Fiterman et al. | |
| 5,730,451 | A | 3/1998 | Walker | |

(Continued)

*Primary Examiner* — Fenn Mathew
*Assistant Examiner* — Madison L Poos
(74) *Attorney, Agent, or Firm* — Miller, Matthias & Hull LLP

(57) ABSTRACT

A lid for a storage receptacle includes a substantially planar top panel including a plurality of openings, a substantially planar slideable closure having a plurality of closure portions capable of closing each of the plurality of openings in the top panel, and a plurality of accessible portions capable of allowing access through each of the plurality of openings in the top panel. The lid further includes a guide mechanism capable of guiding the slideable closure between a first position and a second position, and an activation mechanism capable of receiving an input to move the slideable closure between one of the first position and the second position along the guide mechanism.

14 Claims, 10 Drawing Sheets

(56) References Cited

U.S. PATENT DOCUMENTS

| | | | | |
|---|---|---|---|---|
| 6,105,805 | A * | 8/2000 | Labelle | B60P 3/226 220/262 |
| 6,726,032 | B2 | 4/2004 | Sullivan | |
| 8,485,134 | B2 * | 7/2013 | Dorsey | A01K 1/0245 119/453 |
| 2005/0194385 | A1 * | 9/2005 | Lu | B65F 1/1607 220/263 |
| 2008/0199299 | A1 * | 8/2008 | Baader | B65F 1/141 414/811 |
| 2010/0116822 | A1 * | 5/2010 | Perelli | B65F 1/0053 220/4.03 |
| 2010/0289393 | A1 * | 11/2010 | Cantrell | B65F 1/006 312/293.2 |

* cited by examiner

CLOSEOUT COVER FOR WASTE RECEPTACLE OPENINGS

TECHNICAL FIELD

The field of the embodiments presented herein relate to a cover for either a folding or rigid frame stowage cart configured to provide for discrete storage of different waste items aboard a commercial aircraft and, in particular, to a cover on the stowage cart for use within a bay typically within a galley of the commercial aircraft.

BACKGROUND

Passengers traveling by commercial air typically generate a lot of waste material that the flight attendants pick up just before the aircraft lands at the destination airport. Typically the flight attendants walk up and down the aisles with plastic bags to put the waste material in. This takes a significant amount of time and the flight attendants often get their hands and clothes soiled. Once the waste material is collected from the passengers, the flight attendants must then sort the waste material by hand in the galley or, alternatively, the filled plastic bags are transported to a sorting facility. Otherwise the waste material may not be sorted at all and may be disposed of in its entirety unsorted. Thus, when collecting the waste material onboard an aircraft the waste material is not collected in a manner best suited for recycling.

It is with respect to these and other considerations that the disclosure herein is presented.

SUMMARY

It should be appreciated that this Summary is provided to introduce a selection of concepts in a simplified form that are further described below in the Detailed Description. This Summary is not intended to be used to limit the scope of the claimed subject matter.

In one embodiment disclosed herein, a lid for a storage receptacle includes a substantially planar top panel having a number of openings, a substantially planar slideable closure having a number of closure portions capable of closing each of the number of openings in the top panel, and a number of accessible portions capable of allowing access through each of the number of openings in the top panel. The lid further includes a guide mechanism capable of guiding the slideable closure between a first position and a second position, and an activation mechanism capable of receiving an input to move the slideable closure between one of the first position and the second position along the guide mechanism.

In another embodiment disclosed herein, a storage receptacle system includes a storage receptacle having a number of segregated containers, and a storage receptacle lid with a substantially planar top panel including a number of openings, a substantially planar slideable closure having a number of closure portions capable of closing each of the number of openings in the top panel, and a number of accessible portions capable of allowing access through each of the number of openings in the top panel. The storage receptacle lid further including a guide mechanism capable of guiding the slideable closure between a first position and a second position, and an activation mechanism capable of receiving an input to move the slideable closure between one of the first position and the second position along the guide mechanism.

In another embodiment disclosed herein, a method of operating a storage receptacle with a closeable lid includes inserting a fire containment device into the storage receptacle, inserting a number of segregated containers into the fire containment device in the storage receptacle, securing the closeable lid to an opening of the fire containment device, each opening of the number of segregated containers, and the storage receptacle. The method further includes removing the storage receptacle from a storage receptacle bay, opening a fire containment cover on the closeable lid, stowing the storage receptacle within the storage receptacle bay, and closing the fire containment cover on the closeable lid.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The embodiments presented herein will become more fully understood from the detailed description and the accompanying drawings, wherein.

DETAILED DESCRIPTION

The following detailed description is directed to a stowage cart configured to receive and discretely store different types of waste materials and, in particular, to stowing the cart within a stowage bay typically used for stowing a meal or beverage cart in a galley of the commercial aircraft. The present disclosure is susceptible of embodiment in many different forms.

Figure 1:
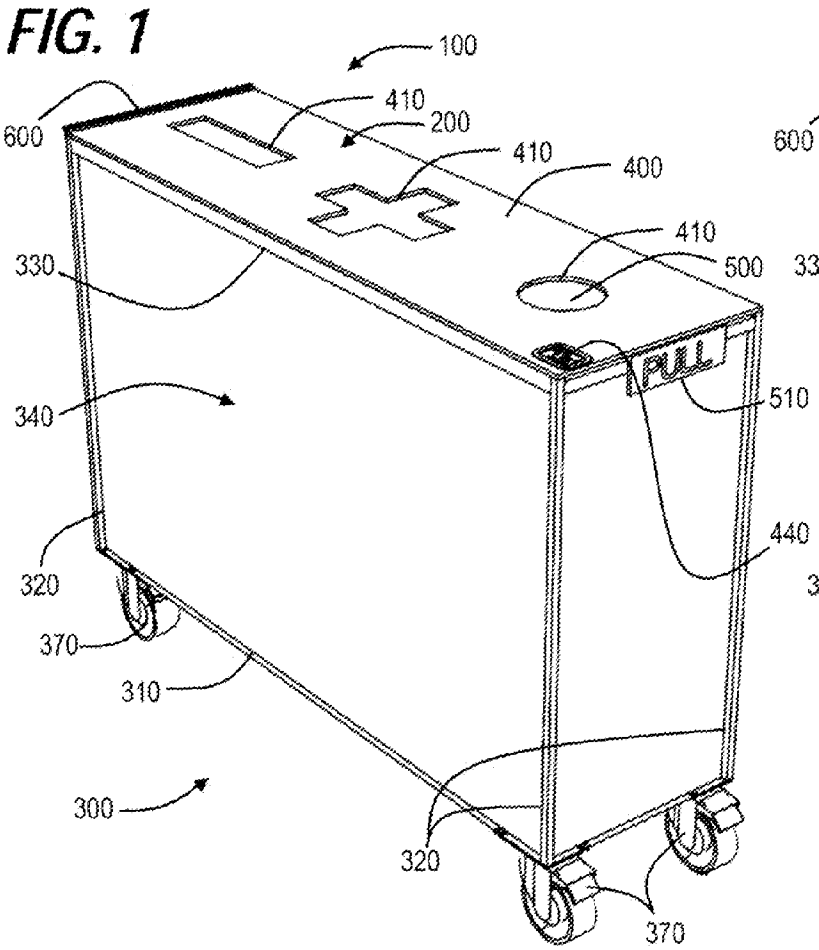
FIG. 1 illustrates one embodiment of a stowage cart including a storage receptacle lid having number of openings and a sliding closure is in a closed position covering each of the openings.

FIG. 1 illustrates a stowage cart 100 having a stowage cart base 300 including a stowage cart lower frame 310, a number of vertical stowage cart side frame members 320 and a stowage cart upper frame 330 that defines a stowage cart inner compartment 340. Stowage cart wheels 370 may be fixedly attached to the stowage cart lower frame 310 to enable the stowage cart 100 to be moved between a stowed position and within a mobile service environment.

The stowage cart 100 may include a stowage cart base 300 consistent with the foldable stowage cart as disclosed in U.S. patent application Ser. No. 14/247,318, entitled, "Foldaway Cart for Wheelchair Stowage Aboard a Commercial Aircraft," herein incorporated fully by reference, or may be incorporated into a rigid frame non-folding stowage cart.

The storage receptacle lid 200 may be attached at one end to the stowage cart base 300 by a hinge 600 and secured at another end to the cart base 300 at or near the stowage cart upper frame 330 by a top panel latch 440. The storage receptacle lid 200 further includes a stowage compartment top panel 400 having a number of top panel openings 410 and an attached slideable stowage compartment closure device 500 including a closure device handle 510 at one end that is accessible outside of the stowage cart inner compartment 340.

The top panel openings 410 may have different shapes representing the type of waste material that is intended to be placed through each of the top panel openings 410. For example, a circular opening may indicate that plastic and glass bottles and metal cans may be placed through the opening. A rectangular opening may indicate that paper and paper products may be placed through the opening. Other shapes beyond what are illustrated may have different purposes to differentiate the type of material that is intended to be placed through each respective opening.

Figure 2:
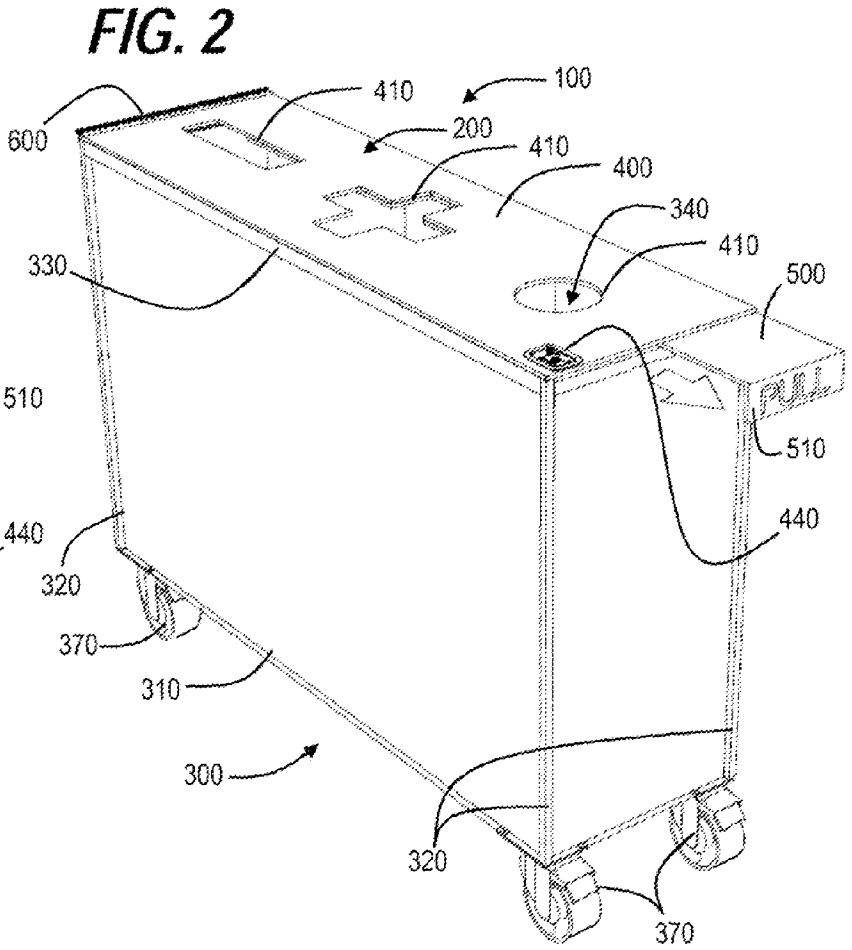
FIG. 2 illustrates one embodiment of the stowage cart of FIG. 1 including the storage receptacle lid where the sliding closure is in an open position allowing access to each of the openings.

FIG. 1 further illustrates one embodiment of a stowage cart 100 including a storage receptacle lid 200 having number of top panel openings 410 and a sliding closure 500 in a closed position that covers each of the top panel openings 410 in the stowage compartment top panel 400. FIG. 2 illustrates one embodiment of the stowage cart 100 of FIG. 1 including the storage receptacle lid 200 where the sliding closure 500 is in an open position that allows access through each of the top panel openings 410. In the configuration of FIG. 2, portions of the sliding closure 500 that covered the top panel openings 410 of the stowage compartment top panel 400 are translated in a direction away from the top panel openings 410 such that each of the top panel openings 410 are now unrestricted and allow access in a direction from an exterior environment of the stowage cart 100 to the stowage cart inner compartment 340.

Figure 3:
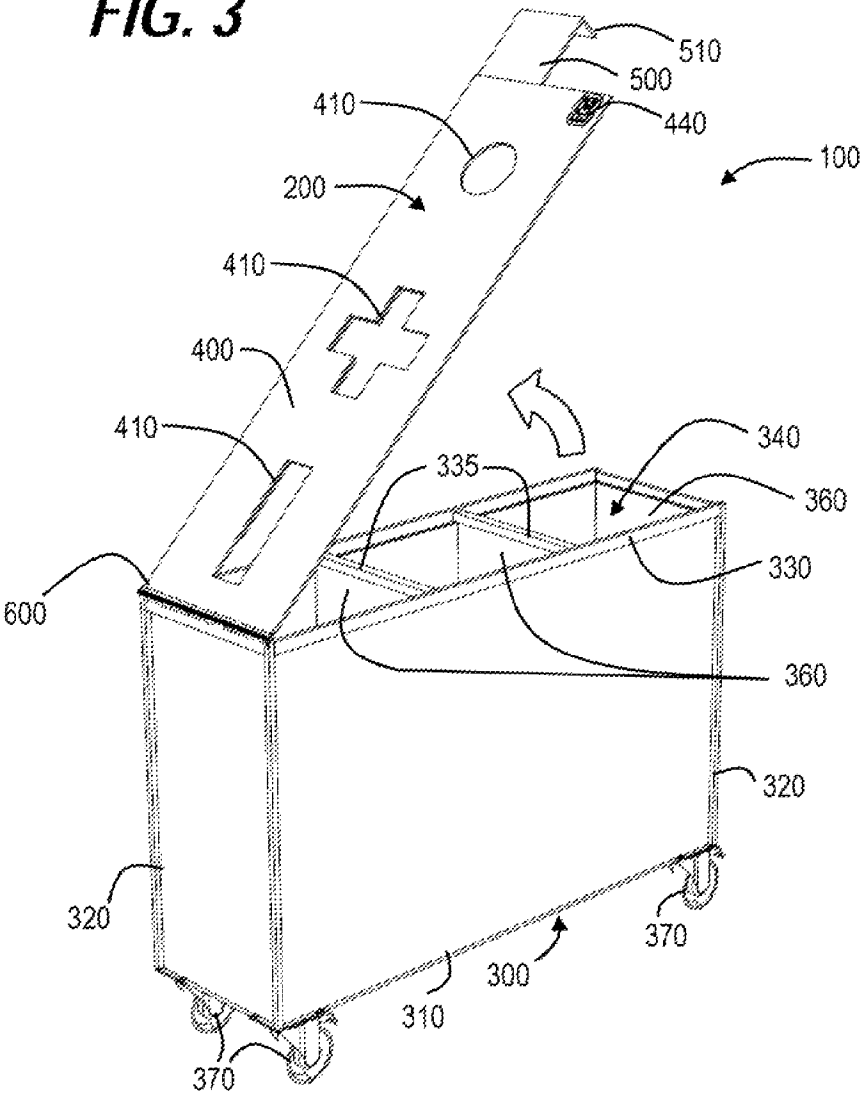
FIG. 3 illustrates one embodiment of the stowage cart of FIGS. 1 and 2 including the storage receptacle lid rotated in an upward position from off of the stowage cart.

FIG. 3 illustrates one embodiment of the stowage cart 100 of FIGS. 1 and 2 including the storage receptacle lid 200 rotated in an upward position off of the stowage cart base 300 by a hinge 600 attached to one end of the stowage receptacle lid 200. The hinge 600 connection to the stowage receptacle lid 200 allows access to the stowage cart inner compartment 340 for insertion of empty storage receptacles and/or plastic bags and the removal of filled storage receptacles and/or plastic bags 360 from the stowage cart inner compartment 340. FIG. 3 further illustrates that the stowage cart upper frame 330 may further include cross members 335 that may separate and provide support for waste receptacle bags placed within the stowage cart inner compartment 340.

Figure 4:
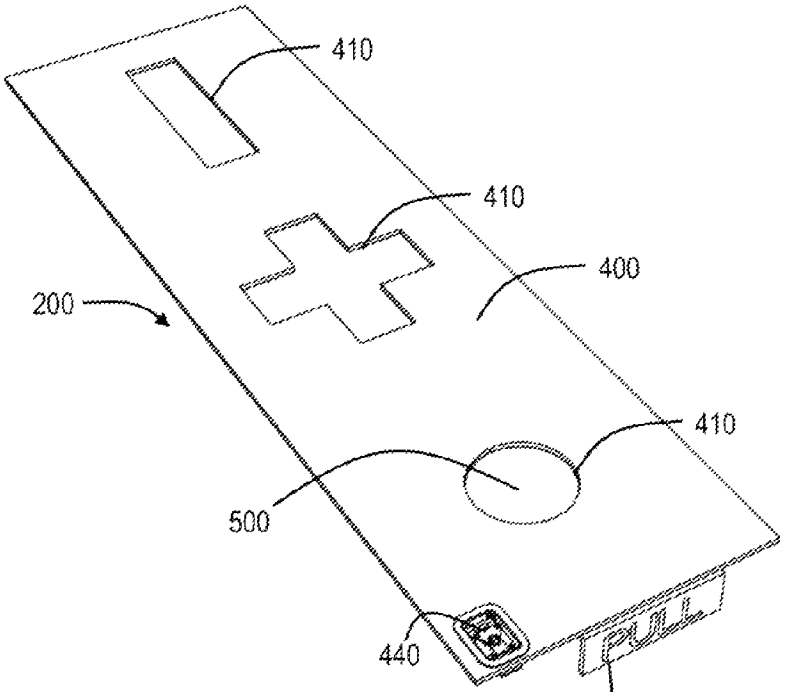
FIG. 4 illustrates one embodiment of a top perspective view of the storage receptacle lid where the sliding closure covers each of the openings.
Figure 5:
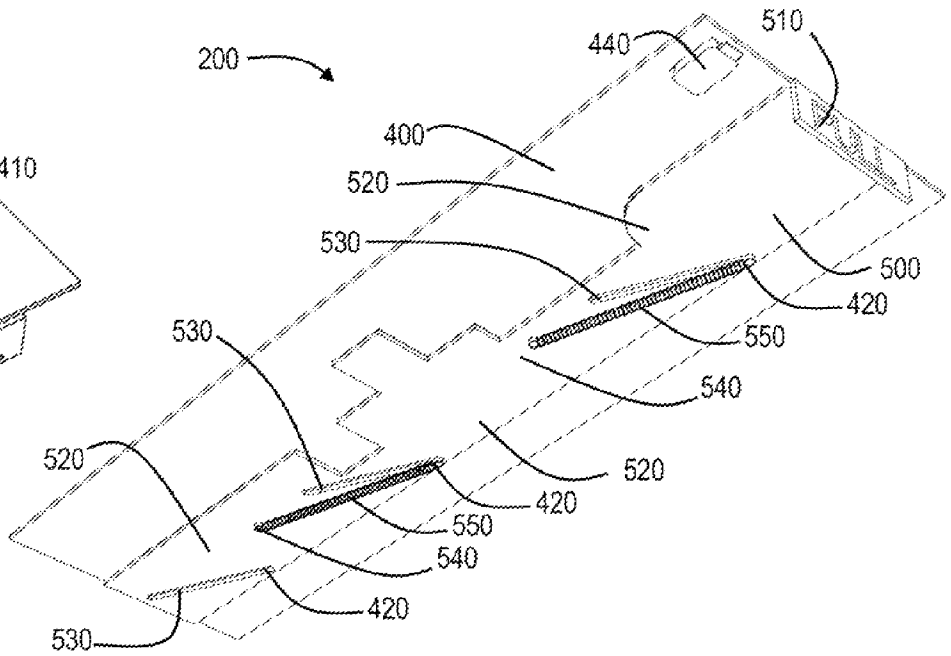
FIG. 5 illustrates one embodiment of a bottom perspective view of the storage receptacle lid where the sliding closure covers each of the openings.

FIG. 4 illustrates one embodiment of a top perspective view of the storage receptacle lid 200 where the sliding closure 500 covers each of the top panel openings 410, and similarly, FIG. 5 illustrates one embodiment of a bottom perspective view of the storage receptacle lid 200 where the sliding closure 500 covers each of the top panel openings 410. The stowage compartment closure device 500 further includes a number of closure device opening forms 520 that correspond to the shape and size of the number of top panel openings 410 of the stowage compartment top panel 400. As illustrated in FIGS. 4 and 5, each of these closure device opening forms 520 are each oriented with respect to the number of top panel openings 410 in the stowage compartment top panel 400 to prevent access through the top panel openings 410. The opening forms 520 also tightly fit flush to the underside of the stowage compartment top panel 400 and thereby allow a substantially air-tight seal to enable the storage receptacle lid 200 to act as a fire containment barrier between the stowage cart inner compartment 340 and an exterior environment above the storage receptacle lid 200. To accomplish this fire containment barrier feature, the storage receptacle lid 200 may be made of any fire-resistant material sufficient to prevent the spread of any combustion through the storage receptacle lid 200, and forms an air-sealed chamber so that a fire within the stowage cart 100 will quickly self-extinguish.

Figure 6:
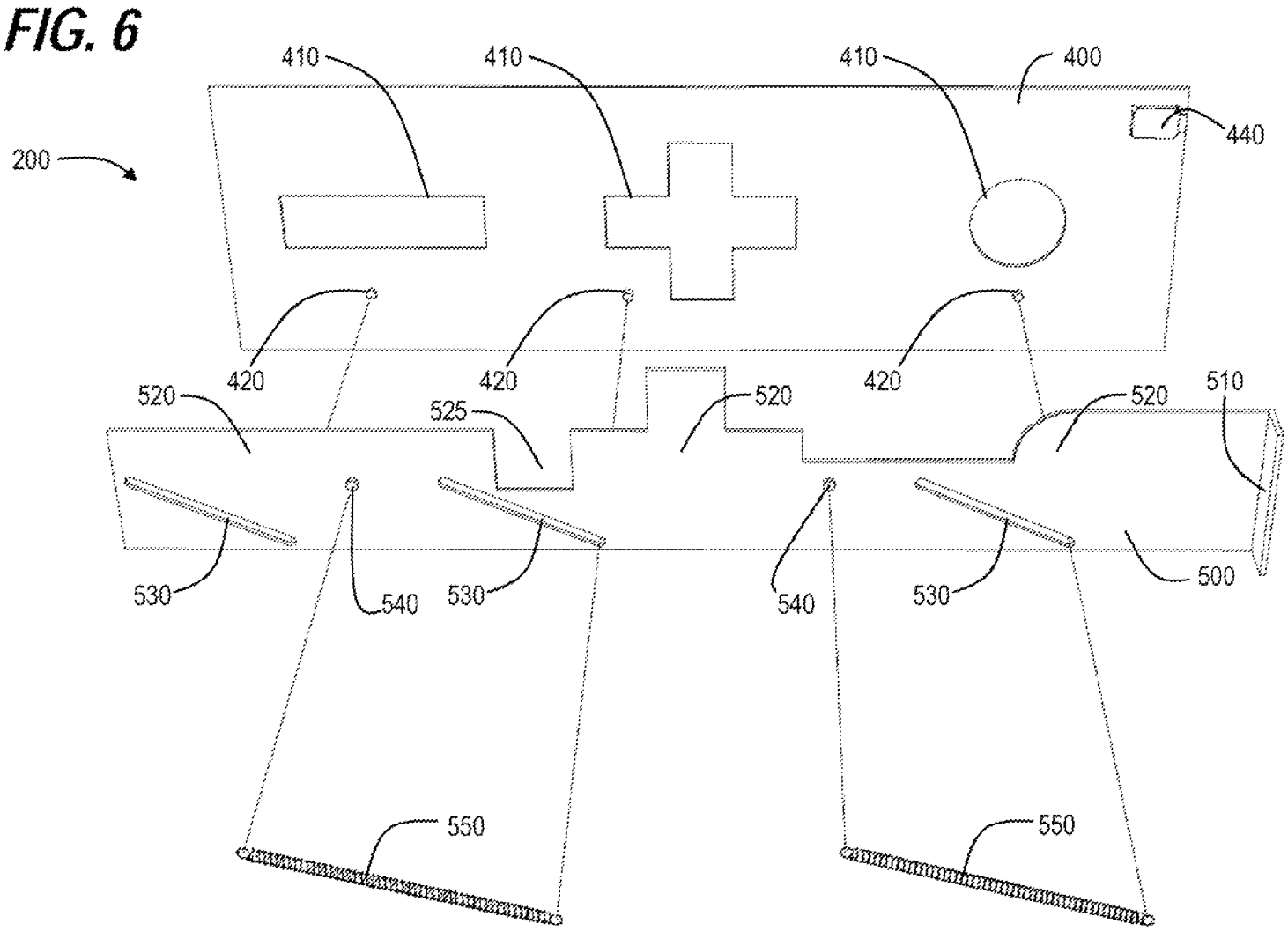
FIG. 6 illustrates one embodiment of a bottom perspective exploded assembly view of the storage receptacle lid of FIGS. 4 and 5 where the sliding closure covers each of the openings.

FIG. 6 illustrates one exemplary embodiment of a bottom perspective exploded assembly view of the storage receptacle lid 200 of FIGS. 4 and 5 where the sliding closure 500 covers each of the top panel openings 410. FIG. 6 illustrates top panel guide pins 420 on the underside of the stowage compartment top panel 400 that engages, for example, closure device slots 530 in the stowage compartment closure device 500. Other configurations may be used to achieve the guided motion of the sliding closure 500 such as rotating guide arms, (not shown), that cause the sliding closure 500 to move between an open and a closed position with respect to the top panel openings 410. The closure device slots 530 direct the movement of the stowage compartment closure device 500 relative to the panel guides pins 420 traveling in the closure device slots 530 such that the stowage compartment closure device 500 travels between two positions defined by the longitudinal end points of each closure device slot 530. The linear closure device slots 530 enable the stowage compartment closure device 500 to align the closure device opening forms 520 under the top panel openings 410 of the stowage compartment top panel 400 in a closed position. The closure device slots 530 are only illustrated for an exemplary purposes and many other configurations and devices may enable the closure device opening forms 520 to be moved into and out of position under the top panel openings 410 of the stowage compartment top panel 400.

Figure 8:
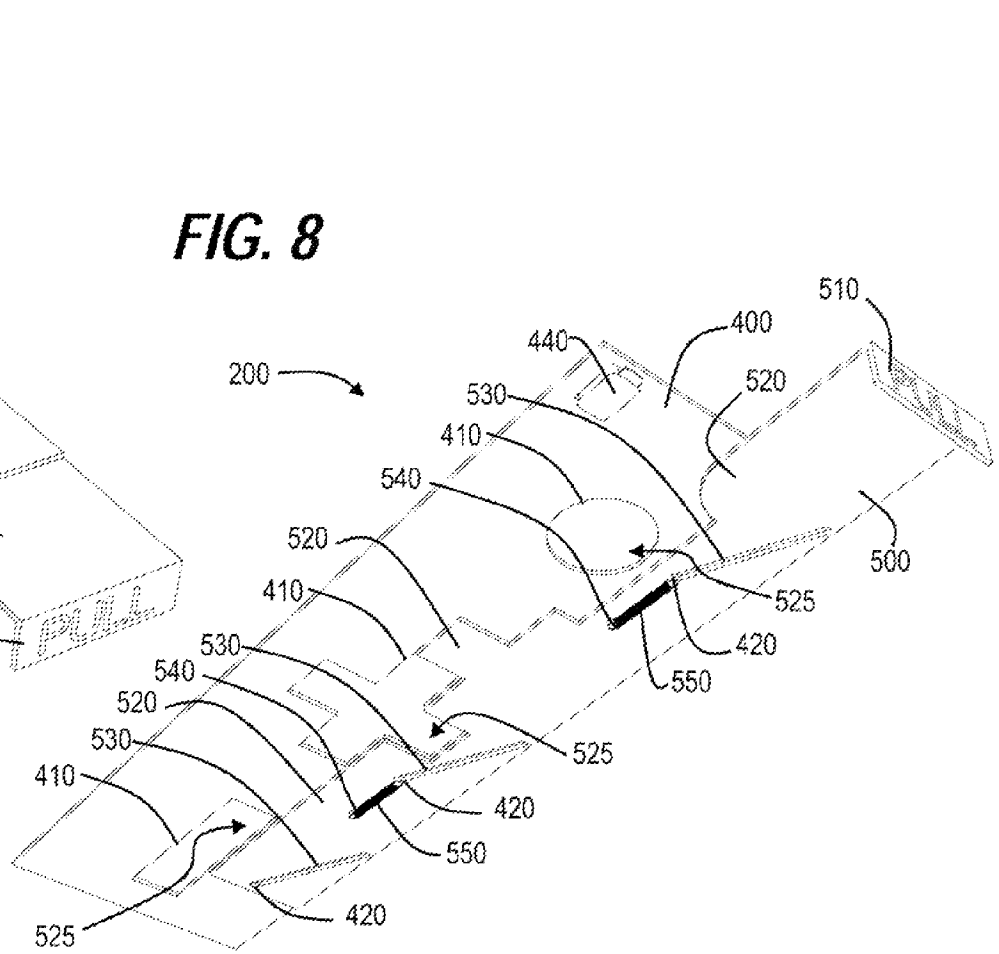
FIG. 8 illustrates one embodiment of a bottom perspective view of the storage receptacle lid where the sliding closure is in an open position allowing access to each of the openings.
Figure 7:
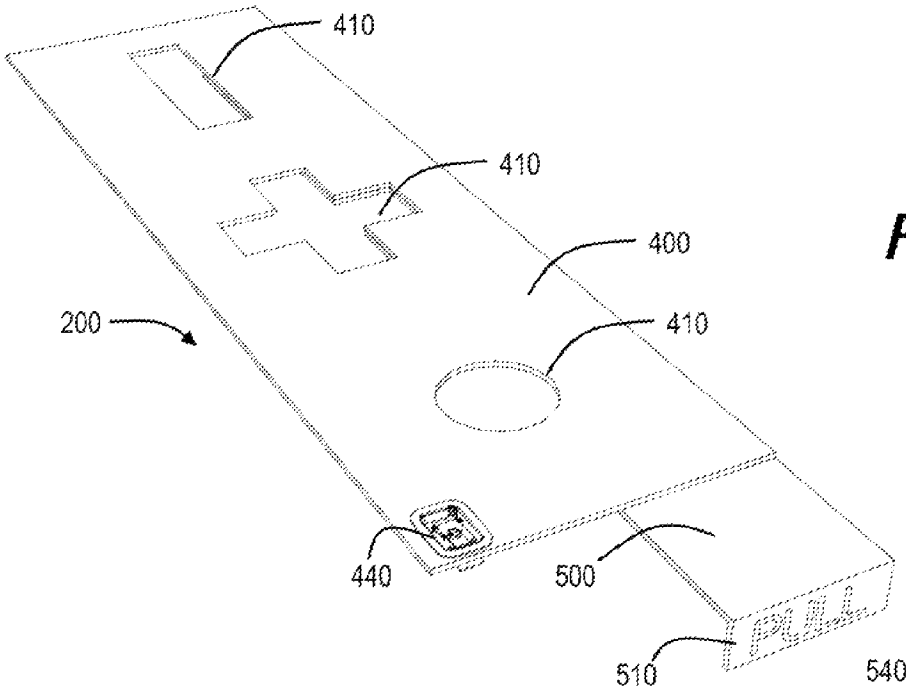
FIG. 7 illustrates one embodiment of a top perspective view of the storage receptacle lid where the sliding closure is in an open position allowing access to each of the openings.
Figure 9:
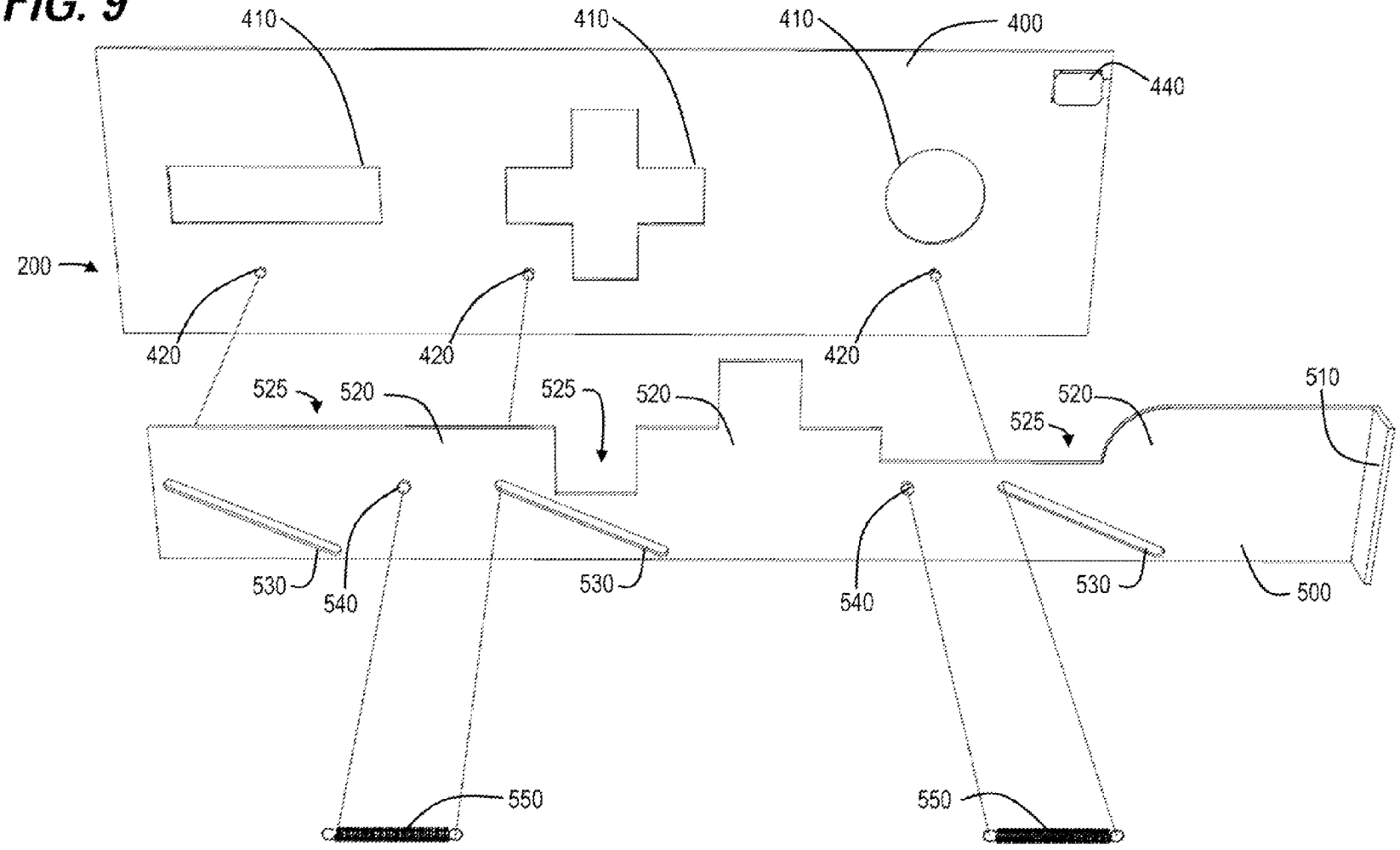
FIG. 9 illustrates one embodiment of a bottom perspective exploded assembly view of the storage receptacle lid of FIGS. 7 and 8 where the sliding closure is in an open position allowing access to each of the openings.

One exemplary option may be to bias the stowage compartment closure device 500 into an open position may be to secure a first end of a linear spring 550 to the top of the panel guides pins 420 and a second end of the linear closure device spring 550 to a closure device spring pins 540 mounted on the underside of the stowage compartment closure device 500. As shown in FIGS. 7-9, the closure device springs 550 may bias the stowage compartment closure device 500 relative to the stowage compartment top panel 400 into an open position to allow access through the top panel openings 410 in the stowage compartment top panel 400. FIGS. 5 and 6 illustrate the closure device springs 550 attached to their respective top panel guide pins 420 and closure device spring pins 540 being in an extended position when the stowage compartment closure device 500 is moved inwardly to the stowage cart inner compartment 340, the closure device springs 550 exert a force on the stowage compartment closure device 500 causing movement in an outward direction from the stowage cart inner compartment 340 as described below. The stowage compartment closure device 500 may stay in a locked or fixed position in both the open and closed positions, where in alternative configurations, the closure device springs 550 may be oriented to either bias the stowage compartment closure device 500 toward either the open position (as shown in FIGS. 7-9), or a closed position, (not shown).

FIG. 7 illustrates one embodiment of a top perspective view of the storage receptacle lid 200 where the sliding closure 500 is in an open position allowing access to each of the top panel openings 410. FIG. 8 illustrates one embodiment of a bottom perspective view of the storage receptacle lid 200 where the stowage compartment closure device 500 in an open position allowing access to each of the top panel openings 410. FIG. 9 illustrates one embodiment of a bottom perspective exploded assembly view of the storage receptacle lid 200 of FIGS. 7 and 8 where the sliding closure 500 in an open position allowing access to each of the top panel openings 410. FIGS. 8 and 9 illustrate the closure device springs 550 attached to their respective top panel guide pins 420 and closure device spring pins 540 that bias the stowage compartment closure device 500 toward an extended position away from the stowage cart inner compartment 340.

FIGS. 8 and 9 additionally illustrate closure device access areas 525 that are defined relative to the stowage compartment closure device 500 that allow the top panel openings 410 of the stowage compartment top panel 400 to be unrestricted when the stowage compartment closure device 500 is moved into an open position. These closure device access areas 525 are represented by voids or open areas in the shape of the stowage compartment closure device 500 that correspond to the shape and size of the top panel openings 410 of the stowage compartment top panel 400.

In summary, a lid 200 for a storage receptacle 100 includes a substantially planar top panel 400 having a number of top panel openings 410, a substantially planar slideable closure 500 having a number of closure portions 520 capable of closing each of the number of top panel openings 410 in the top panel 400, and a number of accessible portions 525 capable of allowing access through each of the number of top panel openings 410 in the top panel 400. The lid 200 further includes a guide mechanism 530 capable of guiding the slideable closure 500 between a first position and a second position, and an activation mechanism, such as the closure device handle 510 or the closure device springs 550, capable of receiving an input to move the slideable closure 500 between one of the first position and the second position along the guide mechanism 530.

A guide mechanism, for example closure device slots 530, aligns the number of closure portions 520 in the first position with each of the number of top panel openings 410 in the top panel 400, and aligns the number of accessible portions 525 in the second position with each of the number of top panel openings 410 in the top panel 400. The guide mechanism 530 further includes a guide portion 530 that directs the movement of the slideable closure 500 into and out of the first position and the second position with respect to the number of top panel openings 410 in the top panel 400. The planar slideable closure 500 may be spring biased into one of the first position or the second position. The closeable lid further includes a latch mechanism 440 capable of releaseably attaching the lid 200 to a storage receptacle 300.

Figure 10:
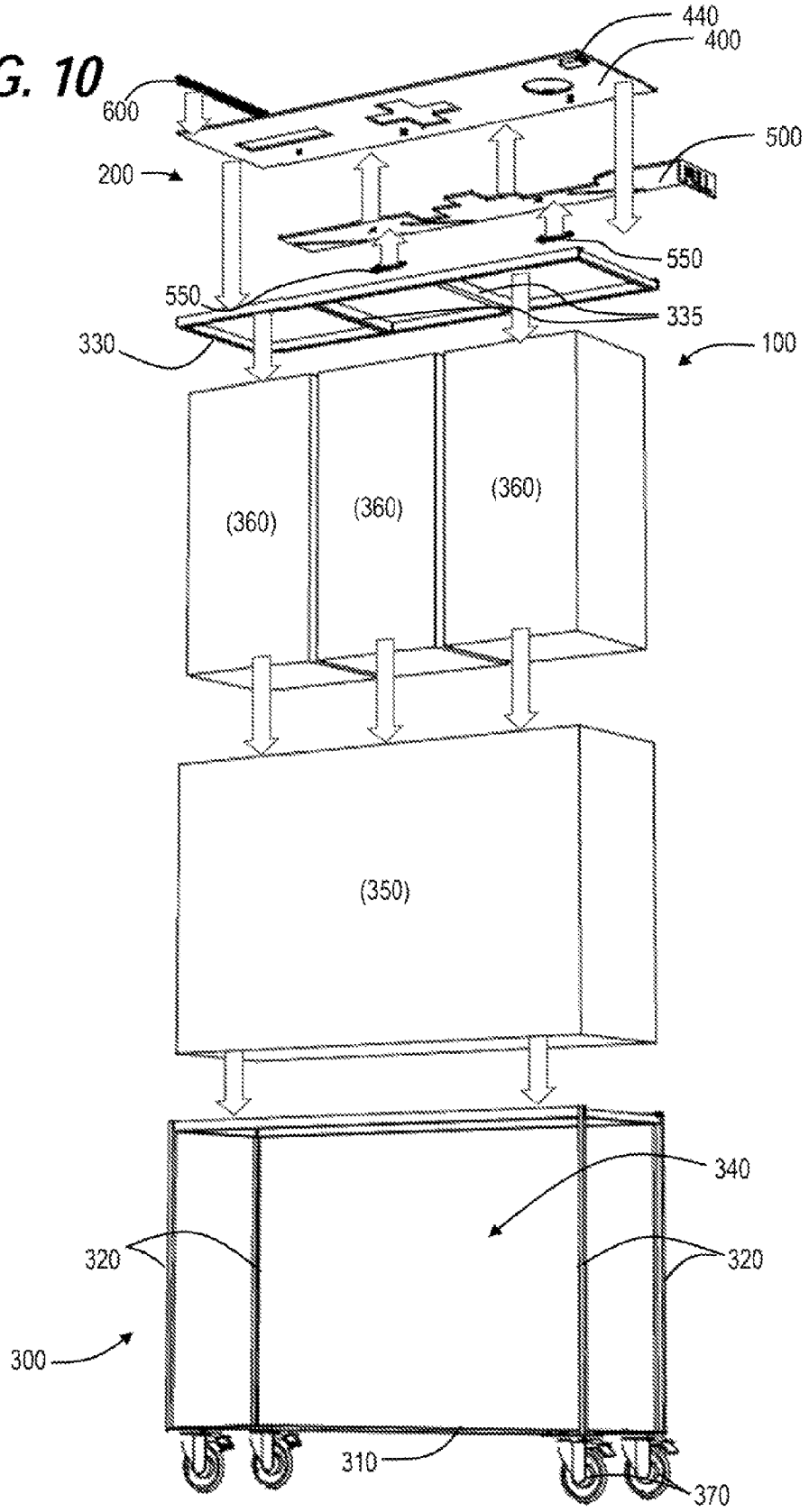
FIG. 10 illustrates one embodiment of a perspective exploded assembly view of the stowage cart and the storage receptacle lid.

FIG. 10 illustrates one embodiment of a perspective exploded assembly view of the stowage cart 100 and the storage receptacle lid 200. A stowage cart base 300 includes a stowage cart lower frame 310 having stowage cart wheels 370 attached thereto. A stowage cart side frame 320 includes a number of vertical members that are attached to a stowage cart upper frame 330 having a number of stowage cart upper frame cross members 335.

A stowage cart inner compartment 340 is defined by the stowage cart lower frame 310, the stowage cart side frame 320 and the stowage cart upper frame 330. A stowage cart fire containment liner 350 fits inside the stowage cart inner compartment 340 to provide a fire containment system with the storage receptacle lid 200 as described above. Within the stowage cart fire containment liner 350 are positioned a number of stowage cart trash/waste bags 360 that correspond to each of the number of top panel openings 410 on the stowage compartment top panel 400. As illustrated, each of the top panel openings 410 allow access to a separate trash/waste bag 360 that may be each dedicated to trash/waste materials of a similar material or a similar material recycling process.

The stowage cart upper frame 330 includes the stowage cart upper frame cross members 335 that provide an opening to hold each of the trash/waste bags 360 in an open position within the stowage cart inner compartment 340. The stowage receptacle lid 200 including the stowage compartment top panel 400 and the stowage compartment closure device 500 is attached to the stowage cart 100 by the hinge 600 at one end, and a top panel latch 440 at an opposite end. The stowage receptacle lid 200 fits closely over the stowage cart upper frame 330 and allows a substantially air-tight seal across the opening of the stowage cart fire containment liner 350 to provide a fire containment enclosure when the stowage compartment closure device 500 is slid into a closed position to close off access to each of the top panel openings 410.

In summary, a storage receptacle system includes a storage receptacle 100 having a number of segregated containers and/or plastic bags 360 and a storage receptacle lid 200. The storage receptacle lid 200 includes a substantially planar top panel 400 having a number of top panel openings 410, a substantially planar slideable closure 500 having a number of closure portions 520 capable of closing each of the number of top panel openings 410 in the top panel 400, and a number of accessible portions 525 capable of allowing access through each of the number of top panel openings 410 in the top panel 400. The slideable closure 500 further includes a guide mechanism 530 capable of guiding the slideable closure 500 between a first position and a second position, and an activation mechanism being either a closure device spring 550 or a manually activated closure device handle 510 capable of receiving an input to move the slideable closure 500 between one of the first position and the second position along the guide mechanism 530. The first or second position being one of an open or closed position with respect to the top panel openings 410.

Each of the number of top panel openings 410 correspond to each of the number of segregated containers and/or plastic bags 360. The storage receptacle 100 further includes a fire containment device 350, wherein the fire containment device 350 and the storage receptacle lid 200 enclose the number of segregated containers and/or plastic bags 360.

The storage receptacle lid 200 at a first end 600 is rotationally connected via hinge 600 to the storage receptacle 100, and the storage receptacle lid 200 at a second end further includes a latch mechanism 440 capable of releaseably attaching the storage receptacle lid 200 to the storage receptacle 100.

The guide mechanism 530 aligns the number of closure portions 520 in the first position with each of the number of top panel openings 410 in the top panel 400, and aligns the number of accessible portions 525 in the second position with each of the number of top panel openings 410 in the top panel 400. The guide mechanism further includes a guide portion 530 that directs the movement of the slideable closure 500 into and out of the first position and second position with respect to the number of top panel openings 410 in the top panel 400.

Figure 11A:
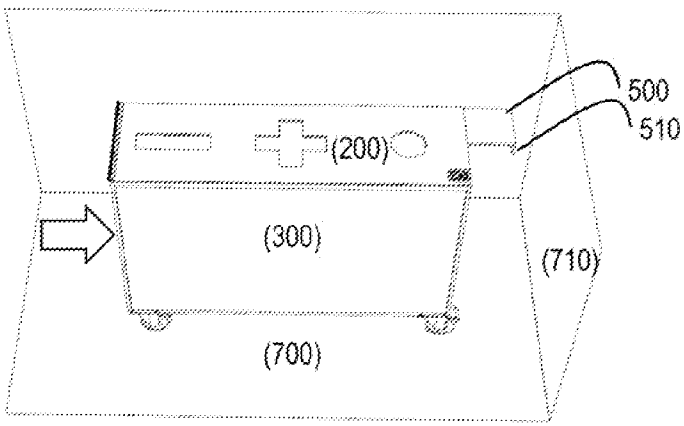
FIG. 11A illustrates one embodiment of a perspective view of a stowage cart being moved toward a stowed position within a utility cart bay.

FIG. 11A illustrates one embodiment of a perspective view of a stowage cart 100 being moved toward a stowed position within a utility cart bay 700 in a direction toward a wall 710. As illustrated, the stowage compartment closure device 500 is in an open position where each of the top panel openings 410 are open to the respective stowage cart trash bags 360 in the stowage cart inner compartment 340, and the closure device handle 510 protrudes out and away from the stowage cart inner compartment 340. This protrusion may be accomplished by manually moving the stowage compartment closure device 500 via the handle 510, or may be accomplished by the springs 550 biasing the stowage compartment closure device 500 in an outward direction with respect to the stowage compartment top panel 400. As discussed above, the stowage compartment closure device 500 may stay in a locked or fixed position in both the open and closed positions, where in alternative configurations, the closure device springs 550 may be oriented to either bias the stowage compartment closure device 500 toward either the open position (as shown in FIGS. 7-9), or a closed position, (not shown).

Figure 11B:
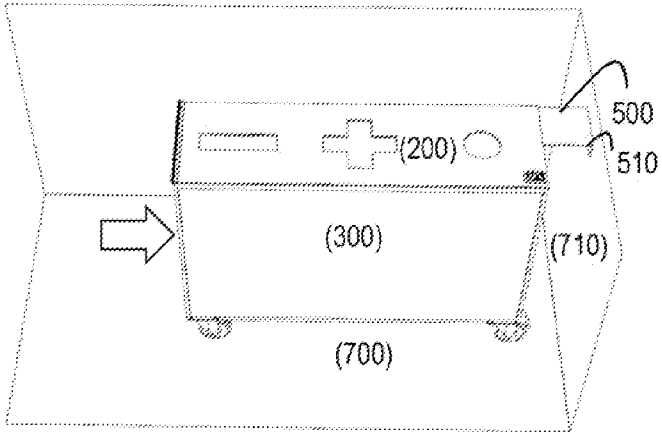
FIG. 11B illustrates one embodiment of a perspective view of a stowage cart being moved toward a stowed position within a utility cart bay where the mechanism for closing the openings of the stowage cart initiates contacts a rear wall of the stowage bay.

FIG. 11B illustrates one embodiment of a perspective view of the stowage cart of FIG. 11A being further moved toward a stowed position into the utility cart bay 700 where the mechanism 510 for closing the openings of the stowage cart 100 initiates contact with a rear wall 710 of the stowage bay 700.

Figure 11C:
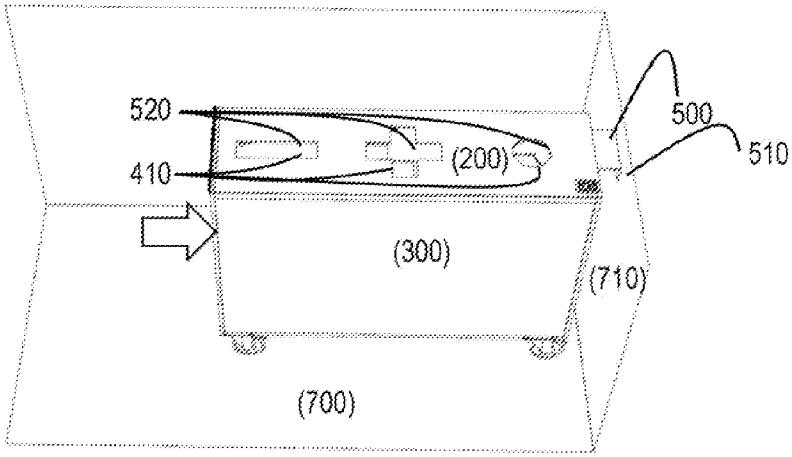
FIG. 11C illustrates one embodiment of a perspective view of a stowage cart being moved toward a stowed position within a utility cart bay where the mechanism for closing the openings of the stowage cart is moved inward to the stowage cart by contacting a rear wall of the stowage bay as the stowage cart is moved toward the rear wall.

FIG. 11C illustrates one embodiment of a perspective view of a stowage cart of FIGS. 11A and 11B being moved toward a stowed position within a utility cart bay 700 where the mechanism 510, i.e., the closure device handle 510, for closing the openings of the stowage cart 100 is moved inward to the stowage cart 100 by contacting a rear wall 710 of the stowage bay 700 as the stowage cart 100 is further moved toward the rear wall 710. As illustrated in FIG. 11C, the closure device opening forms 520 may be seen moving into position to block access to each of the top panel openings 410 in the stowage receptacle lid 200.

Figure 11D:
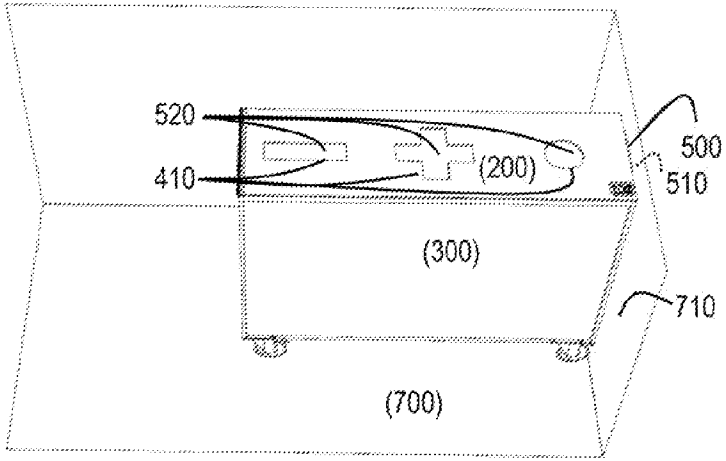
FIG. 11D illustrates one embodiment of a perspective view of a stowage cart being in stowed position within a utility cart bay where a mechanism for closing the openings of the stowage cart is moved inward toward the stowage cart by contacting a rear wall of the stowage bay as a portion of the stowage cart contacts the rear wall.

FIG. 11D illustrates one embodiment of a perspective view of a stowage cart of FIGS. 11A-11C being in stowed position within a utility cart bay 700 where a mechanism 510, (mostly obscured by in the illustration), for closing the top panel openings 410 of the stowage cart 100 is completely moved inward to the stowage cart 100 by contacting a rear wall 710 of the stowage bay 700 as the stowage cart 100 contacts the rear wall 710. As illustrated in FIG. 11D, the closure device opening forms 520 are fully moved into position to block access to each of the top panel openings 410 in the stowage receptacle lid 200. In the alternative, the mechanism 510 of the sliding closure 500 may protrude a distance from the edge of the stowage cart 100 in the fully stowed position within the utility cart bay. This may be a result of the stowage cart 100 not being in full contact with the rear wall 710 of the utility cart bay 700.

Figure 12:
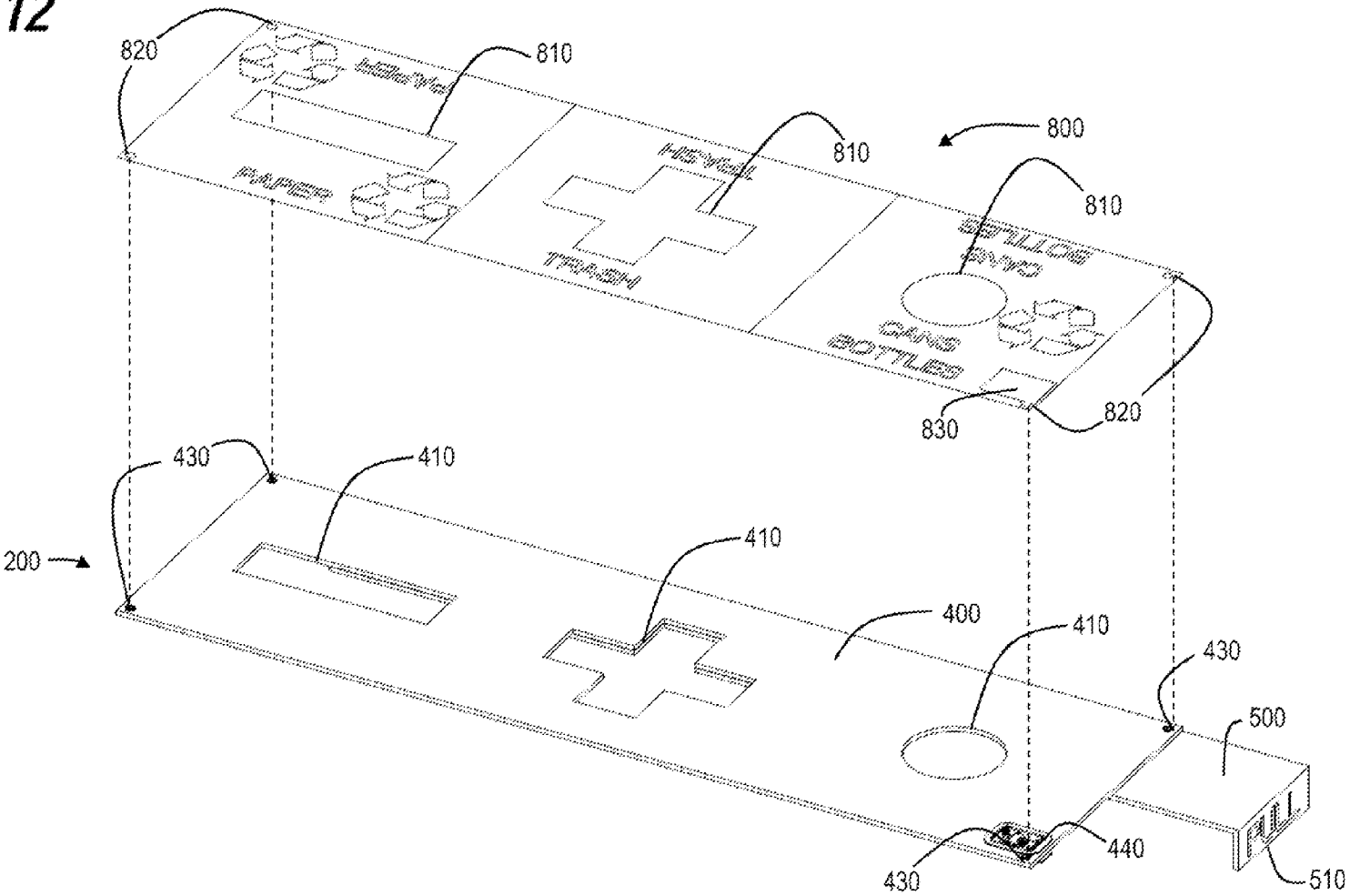
FIG. 12 illustrates one embodiment of a perspective view of a storage receptacle lid including fasteners and an appliqué capable of being attached to the fasteners.

FIG. 12 illustrates one embodiment of a perspective view of a storage receptacle lid 200 including top panel fasteners 430 and a removable/interchangeable top panel appliqué 800 capable of being attached to the fasteners 430. The top panel appliqué 800 includes top panel appliqué openings 810 that are shaped and sized according to the top panel openings 410. Top panel appliqué fastener holes 820 correspond to top panel fasteners 430 to secure the top panel appliqué 800 to the top panel 400. The top panel appliqué 800 may additionally be provided with a top panel applique latch cut-out 830 appropriately sized and shaped to correspond to the top panel latch 440. The top panel may also contain decals, etched/painted aluminum, or other similar variations of graphic design and indicator symbols.

Figure 13:
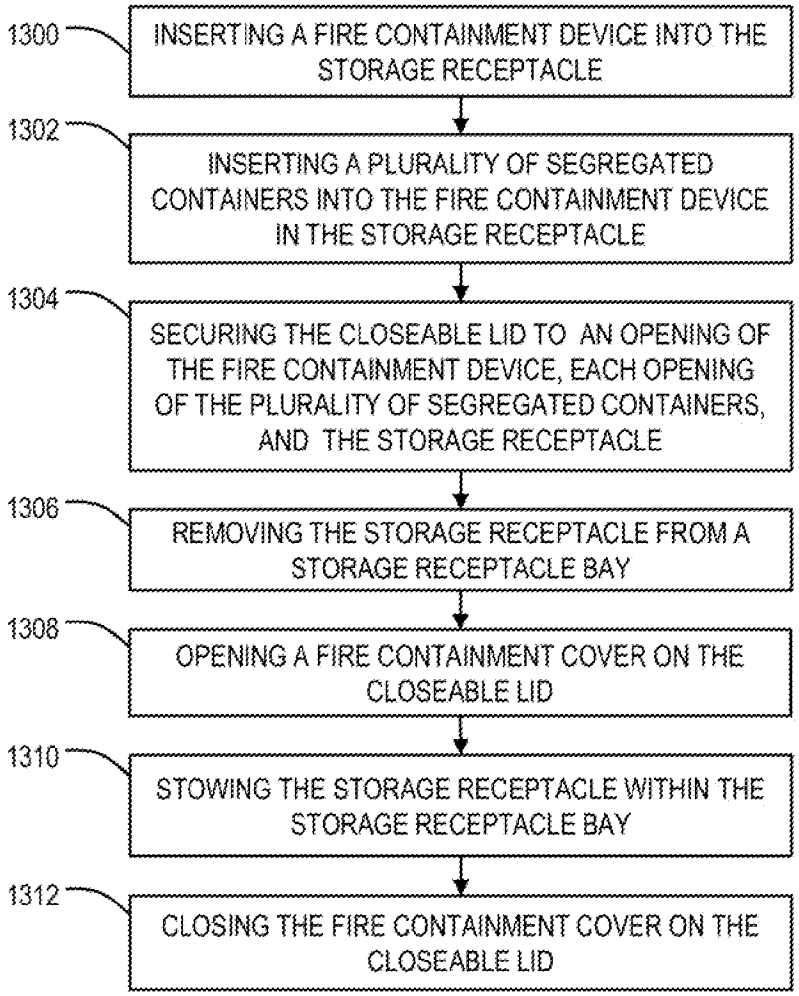
FIG. 13 illustrates a logic flow diagram of a method of operating a storage receptacle including a closeable lid.

FIG. 13 illustrates a logic flow diagram of a method of operating a storage receptacle 100 including a closeable lid 200. The method includes inserting 1300 a fire containment device 350 into the storage receptacle 100, and thereafter, inserting 1302 a number of segregated containers and/or plastic bags 360 into the fire containment device 350 in the storage receptacle 100. The method then secures 1304 the closeable lid 200 to an opening of the fire containment device 350, the openings of each of the number of segregated containers and/or plastic bags 360, and the storage receptacle 100. The method then removes 1306 the storage receptacle 100 from a storage receptacle bay 700, and opens 1308 a fire containment cover 500 on the closeable lid 200. The method then stows 1310 the storage receptacle 100 within the storage receptacle bay 700, and closes 1312 the fire containment cover 500 on the closeable lid 200.

Removing the storage receptacle 100 from the storage receptacle bay 700 may cause the opening of the fire containment cover 500 on the closeable lid 200. Removing the storage receptacle 100 from the storage receptacle bay 700 may enable the opening of the fire containment cover 500 on the closeable lid 200, and when the storage receptacle 100 is stowed within the storage receptacle bay 700, the fire containment cover 500 on the closable lid 200 is prevented from opening.

Stowing the storage receptacle 100 within the storage receptacle bay 700 includes activating a mechanism 510 to move the fire containment cover 500 on the closeable lid 200 to cover each opening 410 of the number of segregated containers and/or plastic bags 360. Removing the storage receptacle 100 from the storage receptacle bay 700 includes activating a mechanism 510 or spring 550 to move the fire containment cover 500 on the closeable lid 200 to uncover each opening 410 of the number of segregated containers and/or plastic bags 360.

Opening of the fire containment cover 500 on the closeable lid 200 and the closing of the fire containment cover 500 on the closeable lid 200 are both directed by a guide mechanism 530 between one of a first closed position and a second open position with respect to each opening 410 of the number of segregated containers and/or plastic bags 360.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

The invention claimed is:

1. A lid for a storage receptacle comprising:
- a substantially planar top panel including a plurality of openings, each opening having a different size or shape;
- a substantially planar slideable closure having
  - a plurality of closure portions shaped according to the plurality of openings and capable of closing each of the plurality of openings in the top panel, and
  - a plurality of accessible portions shaped according to the plurality of openings and capable of allowing access through each of the plurality of openings in the top panel;
- a guide mechanism capable of guiding the slideable closure inward from a side of the top panel and forward toward an end of the top panel from a first position to a second position and outward toward the side of the top panel and aft away from the end of the top panel from the second position to the first position; and
- an activation mechanism capable of receiving an input to move the slideable closure between one of the first position and the second position along the guide mechanism.

2. The lid according to claim 1, wherein the guide mechanism aligns the plurality of closure portions in the first position with each of the plurality of openings in the top panel.

3. The lid according to claim 1, wherein the guide mechanism aligns the plurality of accessible portions in the second position with each of the plurality of openings in the top panel.

4. The lid according to claim 1, wherein the guide mechanism further includes a guide portion that directs the movement of the slideable closure into and out of the first position and the second position with respect to the plurality of openings in the top panel.

5. The lid according to claim 1, wherein the planar slideable closure is spring biased into one of the first position or the second position.

6. The lid according to claim 1, wherein the top panel further includes a plurality of fasteners capable of attaching an appliqué having a plurality of openings that each correspond to the plurality of openings of the top panel.

7. The lid according to claim 1, further comprising a latch mechanism capable of releaseably attaching the lid to the storage receptacle.

8. A storage receptacle system for an aircraft comprising:
- a stowage cart configured for stowage in a utility cart bay of the aircraft, the stowage cart comprising
  - a storage receptacle including a plurality of segregated containers, and
  - a storage receptacle lid including
    - a substantially planar top panel including a plurality of openings, each opening having a different size or shape,
    - a substantially planar slideable closure having
      - a plurality of closure portions shaped according to the plurality of openings and capable of closing each of the plurality of openings in the top panel, and
      - a plurality of accessible portions shaped according to the plurality of openings and capable of allowing access through each of the plurality of openings in the top panel,
    - a guide mechanism capable of guiding the slideable closure inward from a side of the top panel and forward toward an end of the top panel from a first position to a second position and outward toward the side of the top panel and aft away from the end of the top panel from the second position to the first position, and
    - an activation mechanism capable of receiving an input to move the slideable closure between one of the first position and the second position along the guide mechanism such that contact with a wall of the utility cart bay moves the activation mechanism toward the stowage cart and transitions the plurality of closure portions over the plurality of openings to prevent access to the plurality of segregated containers from outside of the stowage cart.

9. The system according to claim 8, wherein each the plurality of openings correspond to each of the plurality of segregated containers.

10. The system according to claim 8, wherein the storage receptacle further includes a fire containment device,
- wherein the fire containment device and the storage receptacle lid enclose the plurality of segregated containers.

11. The system according to claim 8, wherein the storage receptacle lid at a first end is rotationally connected to the storage receptacle, and
- wherein the storage receptacle lid at a second end further includes a latch mechanism capable of releaseably attaching the storage receptacle lid to the storage receptacle.

12. The system according to claim 8, wherein the guide mechanism aligns the plurality of closure portions in the first position with each of the plurality of openings in the top panel.

13. The system according to claim 8, wherein the guide mechanism aligns the plurality of accessible portions in the second position with each of the plurality of openings in the top panel.

14. The system according to claim 8, wherein the guide mechanism further includes a guide portion that directs the movement of the slideable closure into and out of the first position and second position with respect to the plurality of openings in the top panel.

* * * * *